US009839076B2

(12) United States Patent
Metz et al.

(10) Patent No.: US 9,839,076 B2
(45) Date of Patent: Dec. 5, 2017

(54) COOKING APPLIANCE AND FASTENING SYSTEM

(71) Applicant: Miele & Cie. KG, Guetersloh (DE)

(72) Inventors: Thomas Metz, Buende (DE); Ruediger Hoehn, Hiddenhausen (DE); Christian Schulze, Enger (DE); Joerg Adam, Kirchlengern (DE); Andre Peters, Herford (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 14/788,822

(22) Filed: Jul. 1, 2015

(65) Prior Publication Data

US 2016/0014852 A1 Jan. 14, 2016

(30) Foreign Application Priority Data

Jul. 11, 2014 (DE) ..... 10 2014 109 729

(51) Int. Cl.
*H05B 6/64* (2006.01)
*H05B 6/76* (2006.01)
*F24C 15/16* (2006.01)

(52) U.S. Cl.
CPC ..... *H05B 6/64* (2013.01); *H05B 6/6402* (2013.01); *H05B 6/6408* (2013.01);
(Continued)

(58) Field of Classification Search
CPC ..... F24C 15/16; H05B 6/6402; H05B 6/6408; H05B 6/76; H05B 6/763; H05B 6/766
(Continued)

(56) References Cited

U.S. PATENT DOCUMENTS 4,298,780 A * 11/1981 Suzuki ..... H05B 6/6417 219/685
2005/0089354 A1* 4/2005 Chae ..... G03G 15/5029 400/76

(Continued)

FOREIGN PATENT DOCUMENTS

CH 592848 A5 11/1977
DE 102004001685 A1 * 8/2005 ..... F24C 15/16

(Continued)

OTHER PUBLICATIONS

DE 102004001685 A1 Machine Translation, Espacenet.com (Translated Jun. 21, 2016).*

*Primary Examiner* — Tu B Hoang
*Assistant Examiner* — Joseph Baillargeon
(74) *Attorney, Agent, or Firm* — Leydig, Voit & Mayer, Ltd.

(57) ABSTRACT

A cooking appliance includes a cooking chamber with cooking chamber wall, a microwave heat source configured to heat food, and a support device configured to hold a food-supporting member. The cooking chamber wall includes an opening and a lead-through device, and the lead-through device includes a through-hole configured to receive a fastening element of the support device. A tubular guide portion is formed at the through-hole of the lead-through device, and the tubular guide portion includes a safety portion configured to shield against microwave radiation and such that no part of the fastening element is located within the safety portion when the fastening element is in an installed condition in the lead-through device.

15 Claims, 2 Drawing Sheets

(52) U.S. Cl.
CPC ..... *H05B 6/6429* (2013.01); *H05B 6/6479* (2013.01); *H05B 6/76* (2013.01); *F24C 15/16* (2013.01)

(58) Field of Classification Search
USPC ..... 219/738, 739, 756, 762, 763, 752–755, 219/736, 745, 771, 774, 732, 770, 725; 411/92; 99/448; 248/205.1, 231.91, 314, 248/346.03, 235, 342, 48.2; 312/410, 312/408, 351
See application file for complete search history.

(56) References Cited

U.S. PATENT DOCUMENTS

| | | | | |
|---|---|---|---|---|
| 2005/0089384 | A1* | 4/2005 | Pratt | F16B 39/225 411/82 |
| 2013/0260618 | A1* | 10/2013 | Bally | F24C 15/166 439/700 |
| 2015/0271878 | A1* | 9/2015 | Frey | H05B 6/763 219/741 |
| 2015/0359047 | A1* | 12/2015 | Kishimoto | H05B 6/6447 219/704 |

FOREIGN PATENT DOCUMENTS

| | | | | |
|---|---|---|---|---|
| DE | EP 2703731 | A2 * | 3/2014 | F24C 15/16 |
| EP | 2713108 | A2 | 4/2014 | |
| JP | 58016127 | A * | 1/1983 | |
| KR | GB 2264042 | A * | 8/1993 | F24C 15/162 |

* cited by examiner

COOKING APPLIANCE AND FASTENING SYSTEM

CROSS-REFERENCE TO PRIOR APPLICATIONS

Priority is claimed to German Patent Application No. DE 10 2014 109 729.7, filed on Jul. 11, 2014, the entire disclosure of which is hereby incorporated by reference herein.

FIELD

The present invention relates to a cooking appliance and a fastening system having at least one support device for holding food-supporting members in a cooking chamber which can be heated by a microwave heat source.

BACKGROUND

In the prior art, there have been disclosed various support systems which may take the form of, for example, side racks and which are arranged in the cooking chamber of cooking appliances equipped with microwave sources, in particular in the region of the cooking chamber side walls, to receive and support a food-supporting member thereon.

When side racks are installed in cooking chambers of cooking appliances having a microwave source, then such a side rack must be fastened in such a way that radiation can be reliably prevented from leaking from the cooking chamber during microwave operation.

A wide variety of fastening devices have been disclosed in the prior art for this purpose. For example, side racks have been used which are installed by connection to the cooking chamber wall. Such connections are often very complex to manufacture and install, because appropriate precautions have to be taken to prevent microwave radiation from leaking from the cooking chamber.

SUMMARY

A cooking appliance includes a cooking chamber with cooking chamber wall, a microwave heat source configured to heat food, and a support device configured to hold a food-supporting member. The cooking chamber wall includes an opening and a lead-through device, and the lead-through device includes a through-hole configured to receive a fastening element of the support device. A tubular guide portion is formed at the through-hole of the lead-through device, and the tubular guide portion includes a safety portion configured to shield against microwave radiation and such that no part of the fastening element is located within the safety portion when the fastening element is in an installed condition in the lead-through device.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
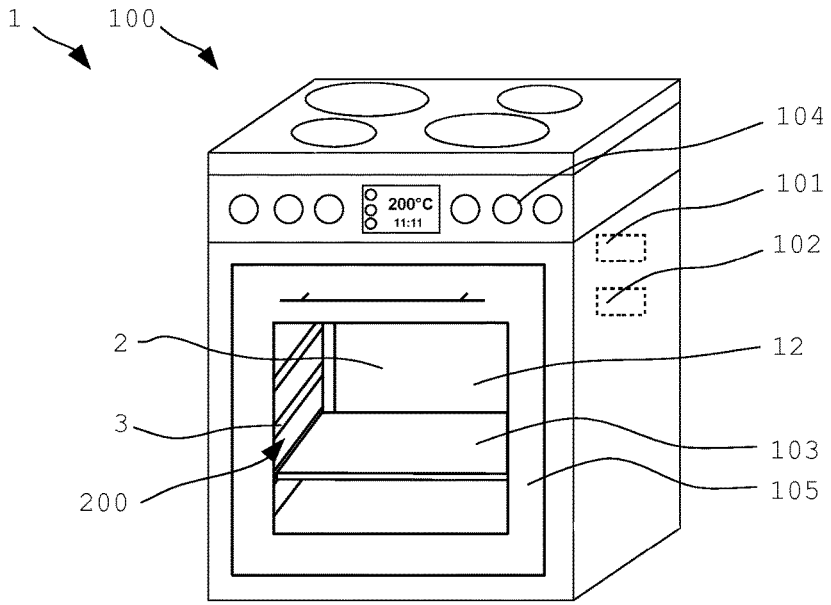
FIG. 1 is a perspective view of a cooking appliance according to the present invention.

The cooking appliance according to the present invention has at least one cooking chamber having at least one cooking chamber wall, as well as at least one microwave heat source for heating food and at least one support device for holding food-supporting members. The cooking chamber wall has at least one opening and at least one lead-through device. The lead-through device has at least one through-hole for receiving at least one fastening element of the support device. At least one tubular guide portion is formed at the through-hole of the lead-through device. The guide portion has at least one safety portion for shielding against microwave radiation, so that when the fastening element is in the installed condition in the lead-through device, no part of the fastening element is located within the safety portion.

The cooking appliance of the present invention has many advantages. One significant advantage is that the tubular guide portion has at least one safety portion for shielding against microwave radiation. Thus, the support device is especially suited for use during microwave operation. The safety portion makes it possible to reliably prevent leakage of microwave radiation, because in the installed condition, no fastening element is located within the safety portion. This makes it possible to prevent, for example, a coaxial conductor effect from occurring between the fastening element and the lead-through device, as a result of which microwave radiation could leave the cooking chamber.

Another advantage of the cooking appliance according to the present invention is that it provides an inexpensive and reliable way of installing the support device for holding food-supporting members. The support device and/or the fastening element may be embodied, for example, as a side rack. In contrast to flat holders, such a design makes it possible to avoid voltage peaks. In addition, such an assembly may be implemented in an uncomplicated, shapely and visually appealing manner.

Another advantage is that, during installation, the fastening element can be easily inserted into the lead-through device, so that a reliable and microwave-shielded connection is created with little effort. In contrast to cooking appliances where the support devices are embossed into the wall, the cooking appliance according to the present invention has the advantage of allowing the use of metallic food-supporting members.

The safety portion for shielding against microwave radiation is preferably configured such that when the fastening element is in the installed condition in the lead-through device, no fastening element is located within the safety portion. The safety portion may also be configured such that when the fastening element is in the installed condition in the lead-through device, no fastening element can be placed within the safety portion. This can be achieved, for example, by providing at least one taper and/or radial ridge and/or at least one projection or the like in the lead-through device, whereby the fastening element is prevented from entering the safety portion.

It is also possible for the lead-through device or the tubular guide portion to include at least one fastening portion. The fastening portion is preferably located in a region outside the safety portion. It is particularly preferred and advantageous that, when installed, the fastening element ends in the fastening portion. This ensures that the safety portion remains clear.

The fastening element and the support device may be formed in one piece. It is also possible for the fastening element to be fixedly and/or non-detachably connected to the support device. The support device may, for example, be bent from a wire and/or a rod, part of the rod being provided as the fastening element which is receivable in the lead-through device. The support device is preferably at least partially composed of at least one metallic material. Particularly preferably, the fastening element is composed of a metallic material. The lead-through device is also composed in particular of a metallic material. However, the support device and/or the lead-through device may also be made from an electrically non-conductive material, and particularly from a plastic material.

Preferably, the tubular guide portion is disposed on the side of the through-hole facing away from the cooking chamber. At least part of the guide portion may also be provided in the through-hole.

The safety portion has in particular a length of greater than or equal to 0.05 mm. Preferably, the safety portion has a length of between one and several millimeters. The safety portion may also extend over more than one centimeter. However, it is also possible for the safety portion to be larger than the distance between the fastening element and the guide portion in the installed condition.

Particularly preferably, the safety portion is formed in that the length of the guide portion of the lead-through device is longer than the portion of the fastening element that is received in the through-hole when in the installed condition. This has the advantage that there will always remain a safety clearance and that no coaxial conductor effect can occur, regardless of the depth to which the installed fastening element has been inserted into the through-hole.

In particular, the diameter of the through-hole is smaller than half the wavelength of the microwave radiation used. Particularly, the diameter of the through-hole may be smaller than 6 cm, and preferably also smaller than 3 cm. The through-hole may also be rectangular, square or polygonal in shape. However, it may also be configured to have rounded corners and/or curves or any other shape. The width and/or inside diameter of the through-hole is in particular smaller than half the wavelength of the microwave radiation used, and preferably smaller than a quarter of the wavelength. By such a design, leakage of microwave radiation from the cooking chamber is effectively counteracted.

It is possible and preferred that the length of the guide portion of the lead-through device be greater than the thickness of the cooking chamber wall in the region of the opening. In particular, the length of the guide portion is twice or three times or several times the thickness of the cooking chamber wall in the region of the opening, preferably more than ten times the thickness of the cooking chamber wall.

In an advantageous embodiment, the lead-through device is at least partially configured as at least one hollow rivet, or includes at least one such rivet. Preferably, the guide portion is configured as at least one hollow rivet. Such an embodiment provides an inexpensive and reliable way of installing the lead-through device or the guide portion on the cooking chamber wall. The length of the hollow rivet is preferably selected such that a safety clearance remains when the fastening element has been inserted into the through-hole. However, it is also possible to use a threaded connection which provides a corresponding through-hole, such as a hollow screw, for example.

However, the tubular guide portion may also be formed in one piece with the cooking chamber wall using, for example, a secondary shaping process without removal of material. It is also possible for the guide portion to be connected to the cooking chamber wall by a material-to-material bond, for example by welding. Another possible option is an interlocking connection where the tubular guide portion is connected to the cooking chamber wall, for example, by compression joining and/or riveting and/or screwing.

In a particularly preferred and advantageous embodiment, at least one isolation device is provided. The isolation device is in particular suitable and adapted for spacing apart and/or electrically isolating the support device from the cooking chamber wall. In particular, the isolation device is suitable and adapted for electrically isolating the fastening element of the support device from the cooking chamber wall, and particularly from the tubular guide portion. A particular advantage of the isolation device is that it counteracts voltage flash-overs or sparking between the support device or the fastening element and the cooking chamber wall or the tubular guide portion during microwave operation.

Preferably, when installed, the isolation device is disposed between the support device and the cooking chamber wall. In the installed condition, the isolation device is preferably also disposed between the fastening element of the support device and the lead-through device or the tubular guide portion, thereby preventing direct contact between these components.

Preferably, the isolation device, or at least a portion thereof, has a suitable wall thickness which not only provides electrical isolation, but also spaces apart the support device from the lead-through device and/or the cooking chamber wall. The spacing allows voltage flash-overs to be prevented even more reliably. The spacing may be greater than 0.1 mm. Preferably, the spacing is greater than or equal to 0.5 mm.

In particular, the isolation device is at least partially disposed in the tubular guide portion. In particular, the isolation device has at least one receiving portion in which, in the installed condition, the fastening element may be received. To prevent electrical breakdowns, the wall thickness of the isolation device, in particular in the region of the receiving portion, may be greater than or equal to 0.1 mm, and preferably greater than or equal to 0.5 mm. The receiving portion may have at least one taper and/or a ridge or the like to limit the insertion of the fastening element in such a way that the safety portion remains clear.

The isolation device is preferably composed of a material which is electrically insulating and/or electrically non-conductive or substantially non-conductive. The electrical conductivity is preferably $<10^{-3}$ S/m. The isolation device is preferably composed of a flexible and/or elastic material, for example, a silicone material. The isolation device may also be composed of another plastic material, for example, of a Teflon material.

The isolation device is preferably resistant to the temperatures expected during operation of the cooking appliance and to the steam expected during steam cooking or cooking in moisture plus mode. The isolation device is preferably also resistant to microwave radiation during microwave operation. For example, it is possible to use a hollow silicone plug which is inexpensive and uncomplicated to install in the lead-through device or the tubular guide portion. Moreover, a material composed of silicone exhibits good resistance during microwave operation.

The isolation device may have at least one spacing device. The spacing device is in particular suitable and adapted for preventing the fastening element from being inserted into the safety portion. The isolation device may also be adapted and suitable to ensure that, when installed, the fastening element ends in the fastening portion. Moreover, the spacing device has the additional advantage that the support device is spaced apart from the cooking chamber wall, and that voltage flash-overs can thereby be reliably prevented during microwave operation.

In particular, the spacing device is disposed toward the cooking chamber so that the support device and/or the fastening element are maintained at a distance from the cooking chamber wall. This makes it possible to prevent voltage flash-overs during microwave operation. The isolation device may, for example, take the form of a plug which is inserted into the guide portion. The bearing face of the plug within the cooking chamber or at the cooking chamber wall may be formed with a suitable thickness so that part of the isolation device acts as a spacing device, preventing the fastening element from being inserted too deeply. The spacing device and the isolation device may be formed in one piece.

In another preferred embodiment, the cooking appliance includes at least one steam generator device associated with the cooking chamber. The steam may be provided for heating and/or for moisture control, for example, during what is referred to as "moisture plus" cooking. The isolation device has at least one blind hole for receiving at least a portion of the fastening element. The isolation device is in particular suitable and adapted for sealing the opening in the cooking chamber wall and/or the through-hole. To this end, the isolation device essentially provides sealing against the steam present in a cooking appliance having a steam heat source.

This has the advantage of allowing the fastening element to be received in an isolated and space-apart relationship, while enabling the through-hole to be sealed steam-tight in an uncomplicated manner. In this way, leakage of steam from the opening or the lead-through device is reliably counteracted.

The depth of the blind hole is preferably less than the length of the portion of the fastening element that is disposed within the opening. Such a blind hole has the advantage of preventing the fastening element from being inserted into the safety portion. However, it is also possible to provide at least one taper and/or a ridge or the like in the blind hole to block the fastening element from being inserted into the safety portion.

Preferably, the isolation device has at least one mounting aid. The mounting aid may be provided on the isolation device in the form of a projection and/or an extension. In particular, the mounting aid is formed in one piece with the isolation device. This makes the isolation device easy to install. Thus, for example, the isolation device may be easily inserted and rapidly pulled through the lead-through device. Thereafter, the mounting aid may remain or be removed, for example, by cutting or breaking it off. Furthermore, a predetermined breaking point or the like may be provided for this purpose.

At least a portion of the isolation device may overlap at least a portion of the lead-through device and at least a portion of the cooking chamber wall.

Preferably, the isolation device projects from the lead-through device or the guide portion into the cooking chamber, thereby overlapping in particular the separation or transition between the cooking chamber wall and the lead-through device. The spacing device, too, may be provided for covering or concealing the transition. This enables the through-hole to be sealed in an inexpensive and uncomplicated manner Moreover, the isolation device may have an oversized diameter with respect to the through-hole. Preferably, the isolation device is configured as a cylindrical or tubular hollow plug whose diameter is correspondingly greater than the diameter of the tubular guide portion. This is provided for, in particular, in an isolation device composed of a flexible and/or elastic material. Thus, a steam-tight engagement of the isolation device can be achieved in an uncomplicated manner.

It is also possible and preferred that the isolation device have at least one fastening device for attachment to the lead-through device. The fastening device is preferably provided on the side of the cooking chamber wall facing away from the cooking chamber. It is also possible to provide a fastening device on the side facing the cooking chamber. For example, the spacing device may at least partially be configured as a fastening device. In particular, the isolation device has a latching device, for example, at least one undercut and/or at least one latching hook or the like. Preferably, the isolation device is slightly stretched during and/or after the attachment process, thereby enabling a taut and thus steam-tight engagement.

The fastening system according to the present invention is suitable for a cooking appliance which has at least one cooking chamber having at least one cooking chamber wall, and least one microwave heat source. At least one support device for holding food-supporting members is provided. At least one opening and at least one lead-through device are provided for the cooking chamber wall. The lead-through device has at least one through-hole for receiving at least one fastening element of the support device. At least one tubular guide portion is formed at the through-hole of the lead-through device. The guide portion has at least one safety portion for shielding against microwave radiation, so that when the fastening element is in the installed condition in the lead-through device, no part of the fastening element is located within the safety portion.

The fastening system of the present invention has many advantages. A significant advantage is provided by the guide portion, in which no fastening element is disposed. Thus, no coaxial conductor effect occurs between the fastening element and the lead-through device. Thus, the fastening system may be used for attachment of a support device for food-supporting members, while reliably shielding the cooking chamber of a cooking appliance. Thus, the fastening system is especially suited for use during microwave operation.

Preferably, the fastening system has refinements as described analogously for the cooking appliance hereinbefore.

In FIG. 1, a cooking appliance 1 according to the present invention is shown in a perspective view. Cooking appliance 1 can be operated by a user via user controls 104 and has a cooking chamber 2 for cooking food, which is closable by a door 105. Here, cooking appliance 1 has a microwave heat source 102 for warming or heating the food. Other heat sources, such as, for example, an upper heating element and/or a lower heating element, as well as a convection air heat source or the like may be provided. The different heat sources may be operated separately or in any desired combination. Cooking appliance 1 may take the form of both a built-in appliance or a stand-alone cooking appliance 1.

Here, cooking appliance 1 is a combination appliance 100, which has a steam cooking function as well as a so-called "moisture plus" cooking function for preparing foods. For this purpose, a steam generator device 101 is provided which heats and evaporates water by means of a heating device. The steam may be used, on the one hand, conventionally for steam cooking of foods and, on the other hand, the steam may be used for controlling the moisture in cooking chamber 2 during cooking in moisture plus mode.

Cooking chamber door 105 and cooking chamber wall 12 are suitable and adapted for substantially preventing leakage of microwaves and steam. Cooking chamber door 105 can be opened by a door opener. At least one safety device is provided to prevent microwave operation when cooking chamber door 105 is not properly closed.

Cooking chamber 2 is enclosed by a cooking chamber wall 12, which here takes the form of a cooking chamber shell. To position food-supporting members 103, such as, for example, baking trays or wire racks or also food cooking containers, a support device 3 is provided in cooking chamber 2. Here, support device 3 is formed of two side racks attached at opposite lateral surfaces of cooking chamber 2. Here, the side rack is formed of a plurality of wires or rods which are arranged in the longitudinal or in the transverse direction and are connected to one another. Thus, one or more food-supporting members 103 may be inserted into cooking chamber 2 at different vertical positions.

Figure 2:
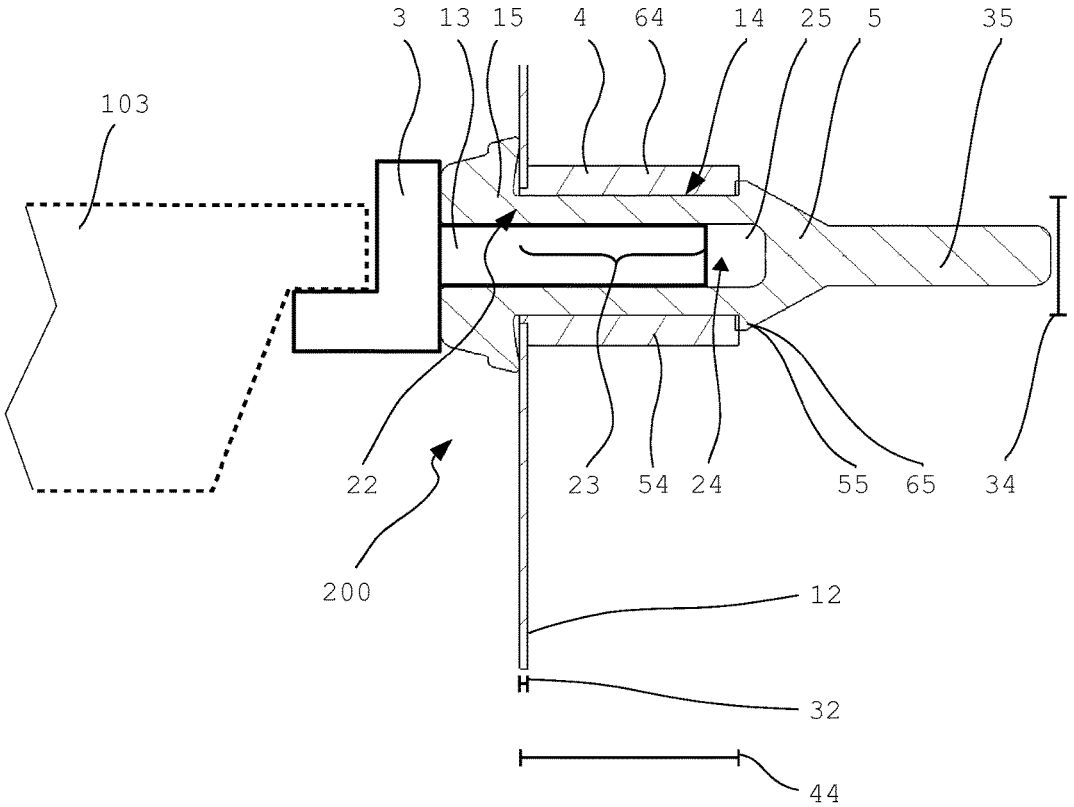
FIG. 2 is a schematic view of a fastening system for a cooking appliance.

FIG. 2 shows a fastening system 200 for a cooking appliance 1 and, for example, for a microwave oven and/or a combination appliance 100. Here, fastening system 200 includes a support device 3. Support device 3 can hold one or more food-supporting members 103 so that these may be positioned at corresponding locations in cooking chamber 2. Fastening system 200 is shown here in a partially cross-sectional side view, the plane of section passing through a lateral surface of a cooking chamber wall 12 of cooking appliance 1.

Support device 3 is shown in highly schematic form and is L-shaped in profile. Support device 3 is shown here merely by way of example and may also be configured to have any other shape. For example, support device 3 may also be U-shaped and/or C-shaped in profile. Other profiles are also possible.

Support device 3 may also be configured as a side rack, for example, and may have one or more support rails. In the installed condition, the support rails are preferably disposed horizontally. Thus, for example, a food-supporting member 103 can be placed with its outer edges on the support rails and slid therealong into cooking chamber 2. It is also possible that a plurality of support rails may be arranged one above another to allow food-supporting member 103 to be positioned at different heights. The support rails may also be connected to one another and/or to other rods for stabilization purposes. However, the side rack may also be formed of one or more rods or wires.

Furthermore, telescoping extension rails and/or rollers or other guide means may be provided to facilitate easy insertion and removal of the food-supporting member 103. However, support device 3 of fastening system 200 may also be configured to be capable of holding an existing support system for food-supporting members 103 or an additional support system. This has the advantage of allowing known or existing support systems to be retrofitted with fastening system 200 in an uncomplicated manner, so that a reliable microwave operation is also possible using these support systems.

In order to attach support device 3, the support device has a fastening element 13 which is received in a lead-through device 4. Lead-through device 4 is installed on cooking chamber wall 12 and has a through-hole 14 capable of receiving fastening element 13. To this end, cooking chamber wall 12 has a corresponding opening 22 in the region of through-hole 14.

Lead-through device 4 is configured here as a hollow rivet 54. Such an embodiment provides an inexpensive and durable way of fastening support device 3 and also greatly increases the ease of installation. For this purpose, opening 22, into which hollow rivet 54 may later be inserted, is formed in cooking chamber wall 12, for example, by punching or drilling.

Here, in order to receive and guide fastening element 13, lead-through device 4 has a tubular guide portion 64, which is here formed by hollow rivet 54. Length 44 of guide portion 64 is longer than the portion 23 of fastening element 13 that is received in lead-through device 4 or hollow rivet 54 when in the installed condition. Thus, a safety portion 24 remains between the end of fastening element 13 and the end of hollow rivet 54 in order to shield against microwave radiation.

Safety portion 24 has the advantage that it prevents the so-called "coaxial conductor effect" from occurring here. Due to safety portion 24, hollow rivet 54 is unable to act as a kind of an outer conductor, and fastening element 13 is unable to act as a kind of an inner conductor. Thus, safety portion 24 effectively prevents leakage of microwave radiation from cooking chamber 2.

Furthermore, diameter 34 of through-hole 14 is configured to be smaller than half the wavelength of the microwave radiation used. Diameter 34 is preferably smaller than 20 mm, and particularly preferably smaller than 10 mm. Moreover, length 44 of guide portion 64 and/or the length of hollow rivet 54 are/is many times greater than thickness 32 of cooking chamber wall 12. Preferably, length 44 is greater than 10 mm, and particularly preferably greater than 20 mm.

Located between hollow rivet 54 and fastening element 13 is here an isolation device 5, which here serves, in particular, for electrically isolating support device 3 and/or fastening element 13 from cooking chamber wall 12. Such an isolation effectively counteracts voltage flash-overs during microwave operation. Isolation device 5 has a spacing device 15 at its end facing the cooking chamber, also for the purpose of preventing voltage flash-overs. Spacing device 15 has here the additional advantage of preventing fastening element 13 from entering safety portion 24.

Isolation device 5 is here composed of a silicone material. Such a material has good electrical insulating properties, good thermal stability and good resistance to microwaves and steam under the conditions expected in a cooking appliance 1 or combination appliance 100. In addition, such an isolation device 5 is economical to manufacture and easy to install because of its flexibility, and provides a suitable seal against steam without excessive complexity. In order to improve the impermeability to steam, isolation device 5 here has a blind hole 25 in which fastening element 13 is received.

During installation, isolation device 5 is inserted through through-hole 14, a mounting aid 35 being provided to facilitate insertion. After the installation is completed, mounting aid 35 may remain on isolation device 5 or be removed, for example by cutting. After insertion, isolation device 5 is latched in place behind hollow rivet 54 on the outside of the cooking chamber. To this end, a fastening device 55 is provided, here in the form of a latching device 65.

Latching device 65 is here provided by a circumferential ridge. During insertion, isolation device 5 is slightly stretched until latching device 65 can grip around one end of hollow rivet 54. In this way, it is also ensured that isolation device 5 is in steam-tight engagement on the inside of the cooking chamber. The end of isolation device 5 facing the inside of the cooking chamber is configured to overlap the separation or transition between cooking chamber wall 12 and lead-through device 4. For example, an enlargement and/or a collar or the like may be provided for this purpose.

Isolation device 5 may also be oversized with respect to diameter 34 of through-hole 14 to ensure a particularly taut and correspondingly steam-tight engagement. Preferably, isolation device 5 is formed in one piece with spacing device 15, mounting aid 35 and fastening device 55, so that it can be manufactured economically using mold tools.

Figure 3:
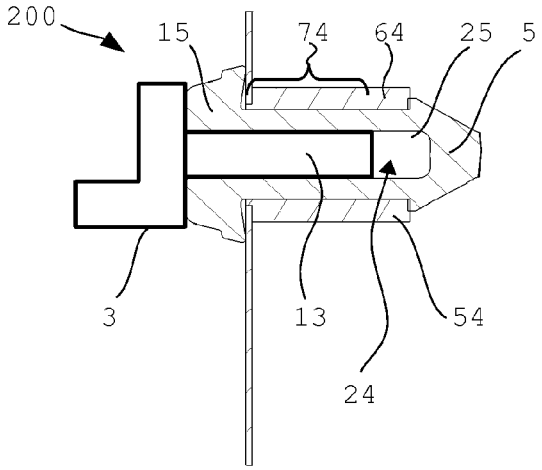
FIG. 3 is a schematic view of a fastening system for a cooking appliance according to another embodiment.

FIG. 3 shows a fastening system 200 and an isolation device 5 from which mounting aid 35 has been removed. Here, fastening element 13 ends in a fastening portion 74 of guide portion 64. Thus, a safety portion 24 remains within guide portion 64 and within hollow rivet 54, so that leakage of microwave radiation is reliably counteracted.

Figure 4:
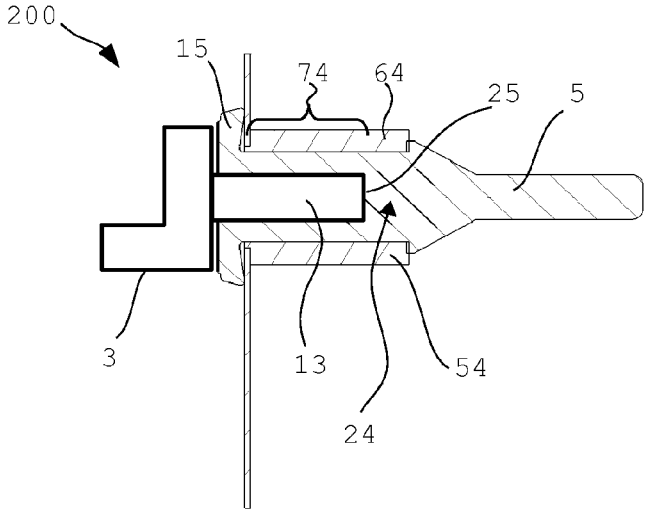
FIG. 4 is a schematic view of a fastening system for a cooking appliance according to a further embodiment.

FIG. 4 shows a further embodiment of a fastening system 200. Here, blind hole 25 of isolation device 5 is made correspondingly shorter, so that fastening element 13 is prevented from being inserted into safety portion 24. In addition, such an embodiment has the advantage of ensuring that there is sufficient clearance between cooking chamber wall 12 and support device 3, regardless of spacing device 15. This makes it possible to prevent voltage flash-overs.

Figure 5:
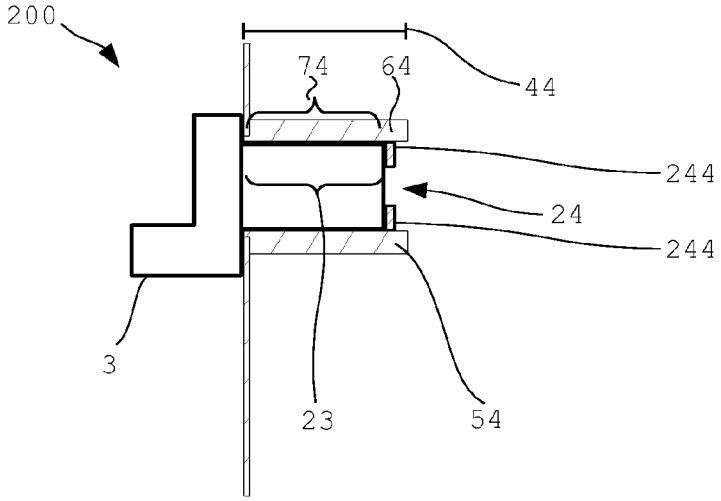
FIG. 5 is a schematic view of another embodiment of a fastening system for a cooking appliance.

FIG. 5 shows a further embodiment of fastening system 200 without an isolation device 5. Here, support device 3 and cooking chamber wall 12 may be electrically conductively connected to each other to prevent voltage flash-overs. To reduce resistance, it is also possible to provide a welded and/or brazed connection or the like between fastening element 13 and hollow rivet 54 and/or cooking chamber wall 12. Length 44 of hollow rivet 54 is selected here to be greater or longer than the portion 23 of fastening element 13 that is received within guide portion 64. Thus, fastening element 13 ends in fastening portion 74, ensuring that safety portion 24 remains clear.

Here, in order to ensure that safety portion 24 remains clear even when a longer fastening element 13 is used, hollow rivet 54 has a circumferential radial taper 244. Here, taper 244 is located at the transition between fastening portion 74 and safety portion 24, so that it is impossible to insert fastening element 13 into safety portion 24. Preferably, safety portion 24 has a length of between one and several millimeters. However, a larger or smaller safety portion 24 is also possible.

Overall, the present invention provides a cooking appliance 1 and a fastening system 200 which are particularly suitable for use during microwave operation. Support devices 3 for food-supporting members 103 can thus be installed in cooking chamber 2 in an inexpensive and uncomplicated manner. Moreover, the occurrence of voltage flash-overs is reliably counteracted by an isolation device 5. A safety portion 24 provides reliable shielding against microwave radiation during microwave operation. Moreover, when the isolation device 5 is suitably embodied as a silicone plug having a blind hole 25, cooking chamber 2 can be inexpensively sealed in such a way that it is steam-tight and resistant to microwaves, which is particularly advantageous in the case of combination appliances 100. Another advantage is that a visually appealing design can be achieved.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 cooking appliance
2 cooking chamber
3 support device
4 lead-through device
5 isolation device
12 cooking chamber wall
13 fastening element
14 through-hole
15 spacing device
22 opening
23 portion
24 safety portion
25 blind hole
32 thickness
34 diameter
35 mounting aid
44 length
54 hollow rivet
55 fastening device
64 guide portion
74 fastening portion
65 latching device
100 combination appliance
101 steam generator device
102 microwave heat source
103 food-supporting member
104 user controls
105 door

200 fastening system
244 taper

What is claimed is:

1. A cooking appliance, comprising:

at least one cooking chamber, comprising:

at least one cooking chamber wall;

at least one microwave heat source configured to heat food; and at least one support device configured to hold at least one food-supporting member, wherein the at least one cooking chamber wall includes at least one opening and at least one lead-through device, the at least one lead-through device including at least one through-hole configured to receive at least one fastening element of the at least one support device, wherein at least one tubular guide portion is formed at the at least one through-hole of the at least one lead-through device, the at least one tubular guide portion extending beyond the at least one fastening element in an installed condition of the at least one lead-through device so as to form at least one safety portion configured to shield against microwave radiation and configured such that no part of the at least one fastening element is located within the at least one safety portion; and an isolation device at least partially disposed between the at least one tubular guide portion and the at least one fastening element to provide electrical isolation, the isolation device including a spacing device disposed between the at least one cooking chamber wall and the at least one support device to provide a steam seal, the isolation device comprised of at least one of a flexible material or an elastic material and configured to stretch so as to grippingly engage with an end of the at least one tubular guide portion so as to provide a steam-tight engagement at the at least one cooking chamber wall.

2. The cooking appliance of claim 1, wherein a diameter of the at least one through-hole is smaller than half of a wavelength of the microwave radiation produced by the at least one microwave heat source.

3. The cooking appliance of claim 1, wherein a length of the at least one tubular guide portion is greater than a thickness of the at least one cooking chamber wall in a region of the at least one opening.

4. The cooking appliance of claim 1, wherein the at least one lead-through device is at least partially configured as a hollow rivet.

5. The cooking appliance of claim 1, wherein the at least one isolation device is configured to electrically isolate the at least one support device from the at least one cooking chamber wall.

6. The cooking appliance of claim 5, wherein the at least one spacing device is configured to prevent the at least one fastening element from being inserted into the at least one safety portion.

7. The cooking appliance of claim 5, further comprising at least one steam generator device configured to heat and evaporate water using a heating device, and wherein the at least one isolation device includes at least one blind hole configured to receive at least a portion of the at least one fastening element.

8. The cooking appliance of claim 5, wherein the at least one isolation device includes at least one mounting aid.

9. The cooking appliance of claim 5, wherein at least a portion of the spacing device overlaps at least a portion of the at least one lead-through device and at least a portion of the at least one cooking chamber wall.

10. The cooking appliance of claim 5, wherein the at least one isolation device has an oversized diameter with respect to the at least one through-hole.

11. The cooking appliance of claim 5, wherein the at least one isolation device includes at least one fastening device configured to be attached to the at least one lead-through device.

12. The cooking appliance of claim 1, wherein the isolation device is oversized with respect to a diameter of the at least one through-hole.

13. A fastening system for a cooking appliance that includes at least one cooking chamber having at least one cooking chamber wall with at least one opening therein, at least one microwave heat source configured to heat food, and at least one support device configured to hold at least one food-supporting member, the fastening system comprising:

at least one lead-through device configured to be provided on the at least one cooking chamber wall of the cooking appliance, the at least one lead-through device including at least one through-hole configured to receive at least one fastening element of the at least one support device, wherein at least one tubular guide portion is formed at the at least one through-hole of the lead-through device, the at least one tubular guide portion extending beyond the at least one fastening element in an installed condition of the at least one lead-through device so as to form at least one safety portion configured to shield against microwave radiation and configured such that no part of the at least one fastening element is located within the at least one safety portion; and an isolation device at least partially disposed between the at least one tubular guide portion and the at least one fastening element to provide electrical isolation, the isolation device including a spacing device disposed between the at least one cooking chamber wall and the at least one support device to provide a steam seal, the isolation device comprised of at least one of a flexible material or an elastic material and configured to stretch so as to grippingly engage with an end of the at least one tubular guide portion so as to provide a steam-tight engagement at the at least one cooking chamber wall.

14. The fastening system of claim 13, wherein at least a portion of the spacing device overlaps at least a portion of the at least one lead-through device and at least a portion of the at least one cooking chamber wall.

15. The fastening system of claim 13, wherein the isolation device is oversized with respect to a diameter of the at least one through-hole.

* * * * *